US010772411B2

(12) United States Patent
Kippen

(10) Patent No.: US 10,772,411 B2
(45) Date of Patent: Sep. 15, 2020

(54) HANDS-FREE ITEM CARRYING DEVICE

(71) Applicant: Anthony John Kippen, Albany, NY (US)

(72) Inventor: Anthony John Kippen, Albany, NY (US)

( * ) Notice: Subject to any disclaimer, the term of this patent is extended or adjusted under 35 U.S.C. 154(b) by 0 days.

(21) Appl. No.: 16/128,274

(22) PCT Filed: Mar. 13, 2017

(86) PCT No.: PCT/US2017/022210
§ 371 (c)(1),
(2) Date: Sep. 11, 2018

(87) PCT Pub. No.: WO2017/156551
PCT Pub. Date: Sep. 14, 2017

(65) Prior Publication Data

US 2019/0125062 A1 May 2, 2019

Related U.S. Application Data

(60) Provisional application No. 62/306,951, filed on Mar. 11, 2016.

(51) Int. Cl.

| | |
|---|---|
| ***A45F 3/14*** | (2006.01) |
| ***A45F 3/10*** | (2006.01) |
| ***A45F 3/04*** | (2006.01) |

(52) U.S. Cl.
CPC ..... *A45F 3/14* (2013.01); *A45F 3/04* (2013.01); *A45F 3/047* (2013.01); *A45F 3/10* (2013.01);
(Continued)

(58) Field of Classification Search
CPC .... A45F 3/047; A45F 3/00; A45F 3/04; A45F 2003/045; A45F 3/08; A45F 3/10;
(Continued)

(56) References Cited

U.S. PATENT DOCUMENTS 3,541,976 A 11/1970 Rozas
5,642,674 A * 7/1997 Joye, Sr. ..... A47B 23/002 108/25

(Continued)

OTHER PUBLICATIONS

PCT/ISA/220—Notification of Transmittal of the International Search Report and the Written Opinion of the International Searching Authority, or the Delaration, dated Jun. 6, 2017, for corresponding PCT International Application No. PCT/US2017/022210.

(Continued)

*Primary Examiner* — Corey N Skurdal
(74) *Attorney, Agent, or Firm* — Heslin Rothenberg Farley & Mesiti P.C.; Kristian E. Ziegler

(57) ABSTRACT

The present disclosure provides hands-free item carrying devices and related methods. The devices include a support platform including an interior surface with an item support portion, a bottom and top ends. The devices further include a flexible stabilizing portion coupled to a bottom portion of the support platform and positioned adjacent to the interior surface. The devices also include a body harness with a pair of shoulder straps, at least one first end portion coupled to the stabilizing portion, and at least one second end portion coupled to at least one of the stabilizing portion and the support platform. When the shoulder straps are worn by a user, the support platform is selectively movable between an open positioned angling away from the user from the bottom end with the top end being distal to the user, and a closed positioned with the top end being proximate to the user.

22 Claims, 6 Drawing Sheets

(52) U.S. Cl.
CPC ... *A45F 2003/045* (2013.01); *A45F 2003/146* (2013.01); *A45F 2003/148* (2013.01); *A45F 2200/0508* (2013.01); *A45F 2200/0516* (2013.01); *A45F 2200/0525* (2013.01)

(58) Field of Classification Search
CPC ..... A45F 3/50; A47D 13/02; A47D 13/025; B65D 33/06; B65D 33/14; B65D 33/16
See application file for complete search history.

(56) References Cited

U.S. PATENT DOCUMENTS

| | | | | |
|---|---|---|---|---|
| 6,302,761 | B1 | 10/2001 | Wrenn | |
| 7,051,910 | B2 | 5/2006 | Sprague et al. | |
| D558,974 | S | 1/2008 | Denzer et al. | |
| 7,780,049 | B1 | 8/2010 | Baranoski | |
| 8,109,421 | B2 * | 2/2012 | McLean | A45C 11/00 190/100 |
| 8,418,629 | B2 | 4/2013 | Yu | |
| 8,505,790 | B2 | 8/2013 | Yu et al. | |
| D697,708 | S | 1/2014 | Denzer et al. | |
| 9,004,330 | B2 * | 4/2015 | White | A45F 5/00 224/256 |
| 9,103,491 | B2 | 8/2015 | Mak | |
| 9,433,279 | B1 * | 9/2016 | Kemper | F16M 13/04 |
| 9,856,895 | B2 * | 1/2018 | Kieley | F16B 2/12 |
| 10,271,663 | B2 * | 4/2019 | Salazar | A47D 13/025 |
| 2004/0011841 | A1 * | 1/2004 | Sprague | A45C 13/30 224/638 |
| 2005/0007685 | A1 | 4/2005 | Bruck et al. | |
| 2005/0077331 | A1 | 4/2005 | Keller et al. | |
| 2007/0164987 | A1 | 7/2007 | Graham | |
| 2008/0121730 | A1 | 5/2008 | Calkin | |
| 2009/0145787 | A1 | 6/2009 | Grander | |
| 2009/0301911 | A1 | 12/2009 | Rubin | |
| 2012/0043359 | A1 | 2/2012 | Bergkvist et al. | |
| 2013/0214022 | A1 | 8/2013 | Harvey | |

OTHER PUBLICATIONS

PCT/ISA/210—International Search Report, dated Jun. 6, 2017, for corresponding PCT International Application No. PCT/US2017/022210.

PCT/ISA/237—Written Opinion of the International Searching Authority, dated Jun. 6, 2017, for corresponding PCT International Application No. PCT/US2017/022210.

PCT/IB/326—Notification Concerning Transmittal of International Preliminary Report on Patentability, dated Sep. 20, 2018, for corresponding PCT International Application No. PCT/US2017/022210.

PCT/ISA/373—International Preliminary Report on Patentability, dated Sep. 11, 2018 for corresponding PCT International Application No. PCT/US2017/022210.

* cited by examiner

HANDS-FREE ITEM CARRYING DEVICE

CROSS-REFERENCE TO RELATED APPLICATION

This present application is a continuation of PCT International Patent Application No. PCT/US2017/022210, filed Mar. 13, 2017, and entitled Hands-Free Item Carrying Device, which perfects and claims the benefit of U.S. Provisional Patent Application No. 62/306,951, filed on Mar. 11, 2016, entitled Wearable Item Allowing for Hands-Free Carrying and Transport of Personal Items, the contents of which are hereby expressly incorporated herein by reference in their entireties.

FIELD OF THE INVENTION

The field of the present disclosure relates generally to item carrying devices and, more specifically, to hands-free item carrying devices that reconfigure between deployed and stowed configurations.

BACKGROUND

Over the past 20 years, mobile electronic devices, such as smartphones, tablet computers, laptops, etc., have grown from mere novelty or luxury items into utilities that are present in all areas of our lives. The average consumer now demands access to technology in real time for almost every recreational, occupational, and personal activity. Further, tablets are quickly over-taking laptops due to consumers preferring their even smaller compact size. At this point, device usage is limited by physical impracticality: the user must use at least one hand to hold and operate the device if a desk, table or the like is not available or conducive to a particular activity of the user.

In the current market, there is no item carrier or accessory that allows a user to carry on with primary activities where usage of the item, such as mobile electronic device or a non-electronic device, is secondary (such as using an item while holding a drink, eating, attending to a child, opening a door, etc.). There is also no item carrier or accessory that allows the user to safely or efficiently perform an occupational activity while also using the item (such as during medical testing, industrial inspection, retail sales, inventory, etc.). Storing items, such as mobile electronic devices or non-electronic devices, to allow or facilitate another activity is inconvenient and sometimes unwieldly. For example, situations requiring frequent changes between using and storing an item is frustrating and annoying.

A hands-free item carrying device (for use with mobile electronic devices and/or non-electronic devices) that can be worn by a user and provide a safe, adjustable, and convenient platform for item usage, is therefore desirable.

BRIEF DESCRIPTION

This disclosure provides wearable item carriers that allow the user or wearer to easily operate or have available, and then safely stow, an item (such as personal electronic device and/or a non-electronic item) that would normally not be considered convenient to the user, such as in situations requiring frequent changes between using and storing the item. When not in use but available, the item may be within immediate reach in a user-friendly position, and is safely held or secured hands-free, allowing the user to carry on with any other activity. In this way, the present disclosure may provide hands-free item carrying devices and related methods.

The hands-free item carrying devices may include a front-facing carrier portion. The front-facing carrier may include a flexible stabilizing portion (e.g., a storage area and/or pouch), an item support platform, and a body harness. The item support platform may be secured to the body harness proximate to the user in a closed position when stowing the item, for example. At least a portion of the item support platform may be positioned distal to or spaced from the user in an open position when making the item available, hands-free, to the user, for example.

The body harness may include a pair of adjustable shoulder straps connecting to the flexible stabilizing portion at front end portions. The shoulder straps may be adjustable and configured such that the item support platform, and therefore the item, is positioned adjacent or at the front of the user's torso when the body harness/shoulder straps are worn by the user. As noted above, the item support platform may be selectively movable between an open position and a closed position. In the closed position, the platform may be removably coupled to the harness, such as to a front portion of the shoulder straps. In the open position, a top portion of the platform panel may be released or de-coupled from the harness and lowered forward away from the user to a user preferred angle. The item may be attached (e.g., removably coupled) to the interior or user-facing side of the platform, and thereby accessible to the user in the open position. The stabilizing portion may be coupled to a lower portion of the platform, and may be used to store or support other items.

In one aspect, the present disclosure provides a hands-free item carrying device. The device comprises a support platform including an interior surface with an item support portion, a bottom end and a top end. The device further comprises a flexible stabilizing portion coupled to a bottom portion of the support platform and positioned adjacent to the interior surface. The device also comprises a body harness comprising a pair of shoulder straps, at least one first end portion coupled to the stabilizing portion, and at least one second end portion coupled to at least one of the stabilizing portion and the support platform. When the shoulder straps are worn by the user, the stabilizing portion is positioned between the user and the support platform, and the support platform is selectively movable between an open positioned with the support platform angling away from the user from the bottom end to the top end such that the top end defines a free end that is distal to the user, and a closed positioned with the top end of the support platform proximate to the user.

In some embodiments, the support platform is configured to pivot between the open and closed positions. In some embodiments, a top portion of the support platform is removably coupled to the front portion of the body harness in the closed position to selectively maintain the support platform in the closed position. In some such embodiments, at least one of the support platform and the front portion of the body harness includes a coupling mechanism configured to removably couple the top portion of the support platform to the front portion of the body harness in the closed position. In some embodiments, the item support portion of the support platform is configured to removably couple an item to the support platform. In some embodiments, the support platform is substantially stiff, and the interior surface of the support platform is substantially planar.

In some embodiments, the at least one second end portion of the body harness is coupled to the stabilizing portion and the support platform. In some embodiments, the stabilizing portion extends away from the interior surface of the support platform. In some such embodiments, the end portion of the support platform defines a first width, and the stabilizing portion defines a second width that is larger than the first width. In some other such embodiments, the stabilizing portion is coupled to and extends along a portion of the interior surface of the support platform along a length direction that extends between the bottom and top ends. In some other such embodiments, the stabilizing portion is coupled to and extends along a portion of the interior surface of the support platform along a width direction that extends between opposing lateral sides of the support platform that extend between the bottom and top ends. In some such embodiments, the at least one first end portion of the body harness is coupled to a medial portion of the stabilizing portion along the width direction.

In some embodiments, the stabilizing portion forms a pouch via a front portion that is coupled to the interior surface of the support platform, a back portion that is spaced from the interior surface of the support platform, and opposing side portions that extend between the front and back portions. In some such embodiments, the stabilizing portion forms a cavity of the pouch that extends along a length direction that extends between the bottom and top ends of the support platform, and along a width direction that extends between opposing lateral sides of the support platform that extend between the bottom and top ends along the length direction. In some other such embodiments, the at least one first end portion of the body harness is coupled to the back portion of the stabilizing portion.

In some embodiments, a length of the at least one second end portion of the body harness is adjustable to adjust the position of the support platform in the open position. In some embodiments, the body harness includes a pair of first end portions that comprise ends portions of front portions of the pair of shoulder straps. In some embodiments, the body harness includes a pair of second end portions that are configured to removably couple to side portions of the body harness that are coupled to back portions of the pair of shoulder straps. In some embodiments, back portions of the pair of shoulder straps are coupled together.

In some embodiments, the device further comprises a pair of strap overlay members coupled to the outer surface of back portions of the pair of shoulder straps, the strap overlay members coupling the back portions of the pair of shoulder straps in a crossed arrangement. In some such embodiments, a first portion of a first strap overlay member that is coupled to a back portion of a first shoulder strap is not directly coupled to the first shoulder strap, and a second portion of a second strap overlay member that is coupled to a back portion of a second shoulder strap is not directly coupled to the second shoulder strap, and the first portion of the first strap overlay member extends across the second shoulder strap between the second shoulder strap and the second portion of the second strap overlay member. In some such embodiments, the second strap extends across the first shoulder strap between the first shoulder strap and the first portion of the first strap overlay member. In some other such embodiments, the first and second strap overlay members are configured such that, when the shoulder straps are worn by the user, the crossover of the first and second shoulder straps is substantially centered along the user's back.

In another aspect, the present disclosure provides a method of manufacturing a hands-free item carrying device. The method comprises obtaining a support platform including an interior surface with an item support portion, a bottom end and a top end. The method further comprises coupling a flexible stabilizing portion to a bottom portion of the support platform such that the flexible stabilizing portion is positioned adjacent the interior surface. The method also comprises coupling at least one first end portion of a body harness comprising a pair of shoulder straps to the stabilizing portion, and coupling at least one second end portion of the body harness to at least one of the stabilizing portion and the support platform such that when the shoulder straps are worn by the user, the stabilizing portion is positioned between the user and the support platform, and the support platform is selectively movable between an open positioned with the support platform angling away from the user from the bottom end to the top end such that the top end defines a free end being distal to the user, and a closed positioned with the top end of the support platform being positioned proximate to the user.

In some embodiments, the stabilizing portion forms a pouch via a front portion that is coupled to the interior surface of the support platform, a back portion that is spaced from the interior surface of the support platform, and opposing side portions that extend between the front and back portions.

These and other objects, features and advantages of this disclosure will become apparent from the following detailed description of the various aspects of the disclosure taken in conjunction with the accompanying drawings.

DETAILED DESCRIPTION

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

Figure 1:
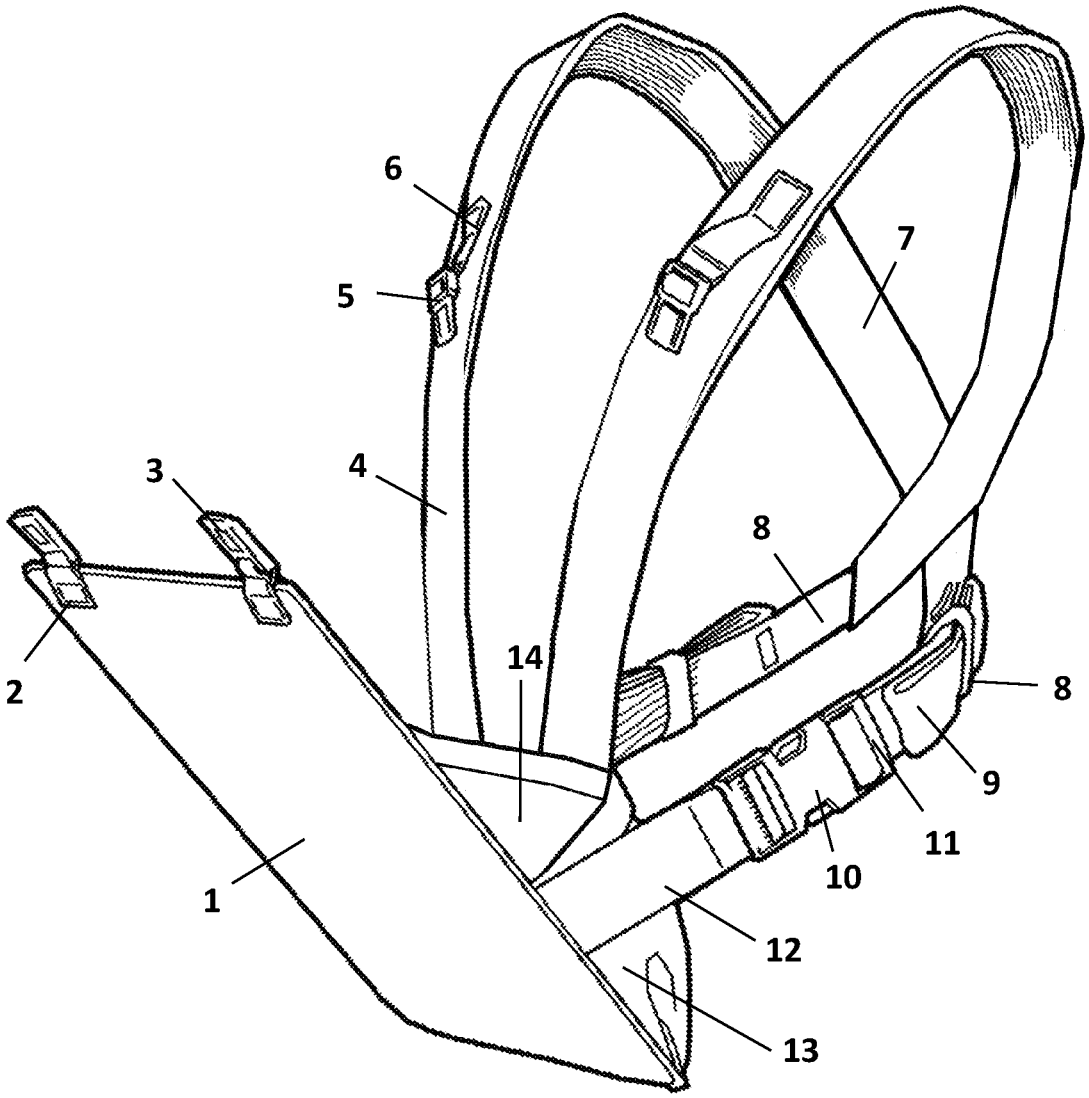
FIG. 1 is a perspective view of an exemplary embodiment of a hands-free item carrying device according to the present disclosure.
Figure 6:
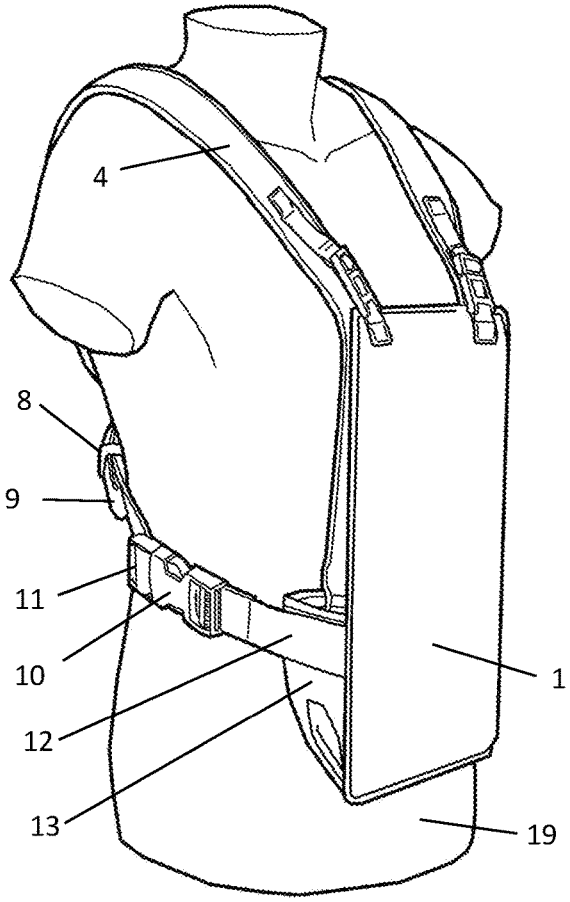
FIG. 6 is a perspective view the hands-free item carrying device of FIG. 1 worn by a user and in a closed configuration.
Figure 7:
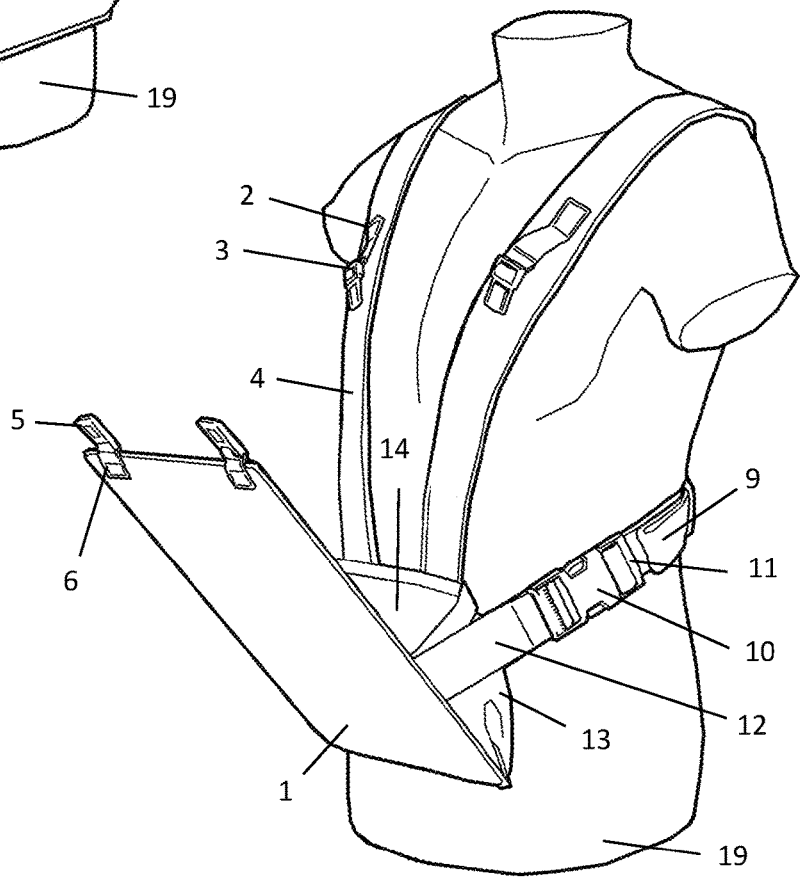
FIG. 7 is a perspective view the hands-free item carrying device of FIG. 1 worn by a user and in an open configuration.
Figure 8:
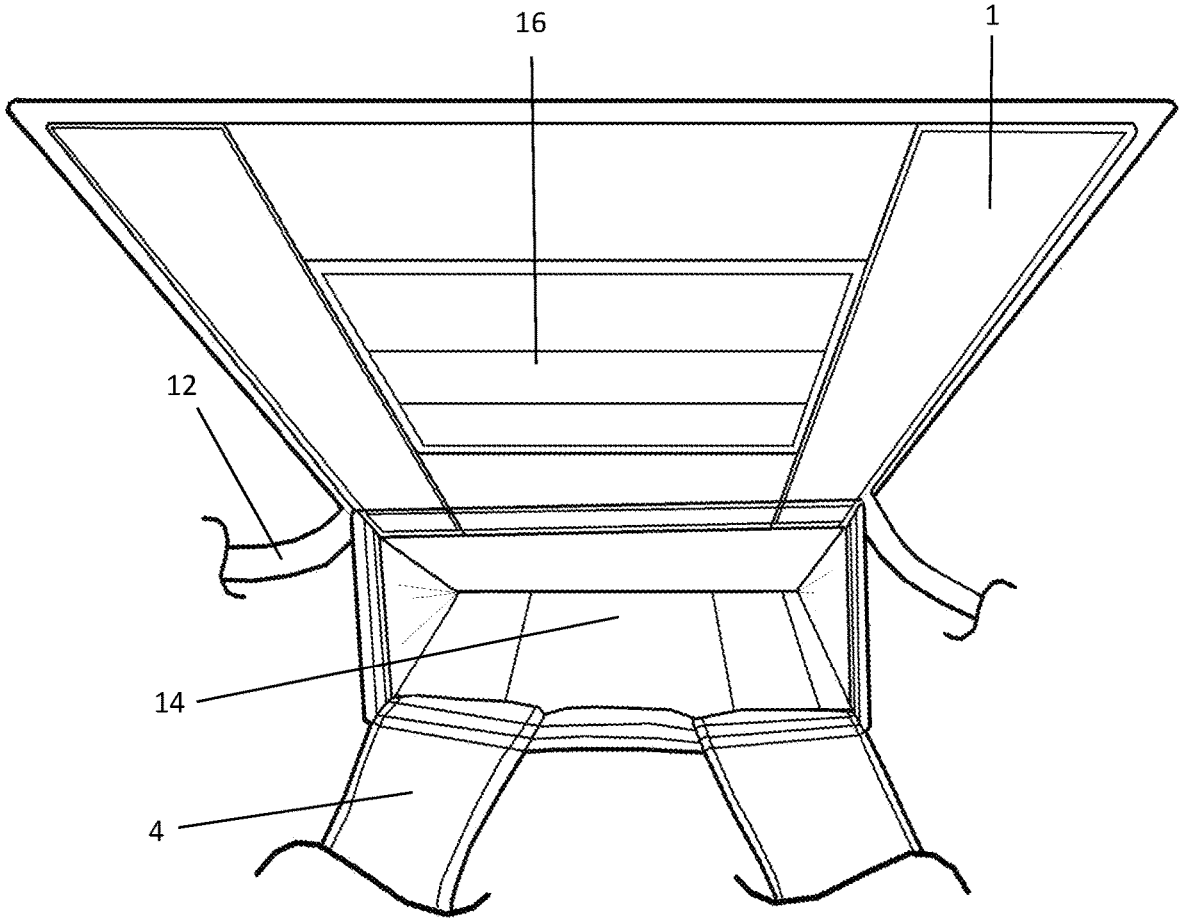
FIG. 8 is a top view of a portion of the hands-free item carrying device of FIG. 1.

As shown in FIGS. 1, 2 and 6-8, the present disclosure provides a hands-free item carrying device that is worn by a user 19 to automatically or mechanically support an item on an item support platform portion 1. In this way, the user 19 can carry the item with them, potentially in an accessible and/or usable position or arrangement, without holding the item otherwise utilizing their hands with the item. As shown in FIGS. 1 and 8, the item support platform portion may include or define an interior surface with an item support portion 16, a bottom end and a top end. As shown in FIGS. 1, 6 and 7, the device may also include a flexible stabilizing portion 14 coupled to a bottom portion of the support platform 1 and positioned adjacent the interior surface of the support platform 1. As shown in FIGS. 1, 2 and 6-8, the device may also include a body harness so that the device can be worn by the user 19. In one exemplary configuration, the body harness may include a pair of shoulder straps with a front end portion 4 coupled to the stabilizing portion 14, and a back end portion 7 coupled to at least one of the stabilizing portion 14 and the support platform 1. The device may be configured such that when the shoulder straps are worn by the user 19, the stabilizing portion 14 is positioned between the user 19 and the support platform 1, as shown in FIGS. 6 and 7. Further, the device may be configured such that, when the shoulder straps are worn by the user 19, the support platform 1 is selectively movable between an open positioned with the support platform 1 angling away from the user 19 from the bottom end to the top end such that the top end defines a free end that is positioned distal to the user 19 as shown in FIGS. 1 and 7, and a closed positioned with the top end of the support platform 1 positioned proximate to the user 19 as shown in FIG. 6. In the open position, the support platform 1 may support the item, hands-free, in an accessible and/or usable position or arrangement. As explained further below, the body harness may be adjustable to suit different users and/or user preferences. For example, at least the length of the shoulder straps may be adjustable, as discussed below.

Figure 9:
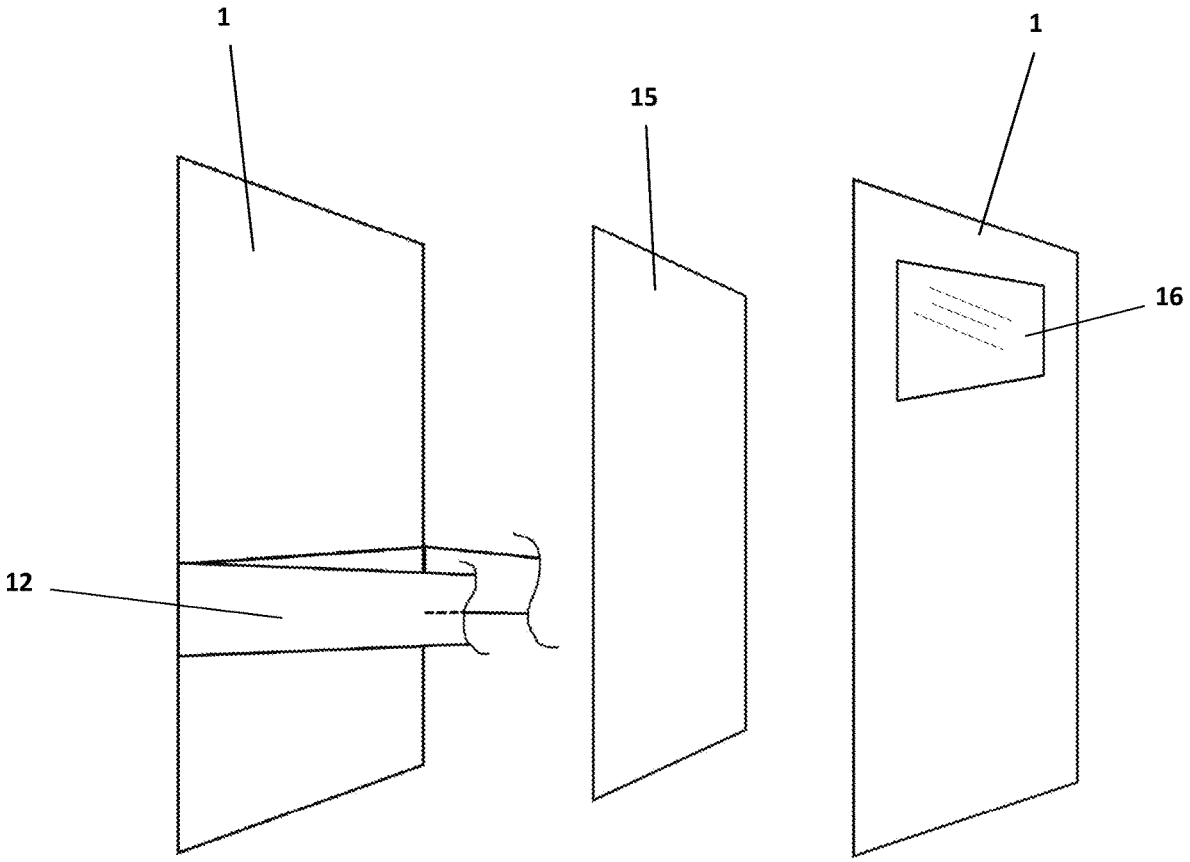
FIG. 9 is an exploded perspective view of an exemplary support platform portion of the hands-free item carrying device of FIG. 1.
Figure 10:
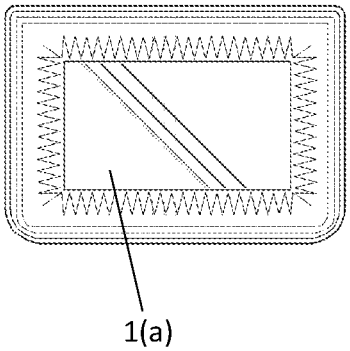
FIG. 10 is a front view of an exemplary front portion of the support platform portion of the hands-free item carrying device of FIG. 1.
Figure 12:
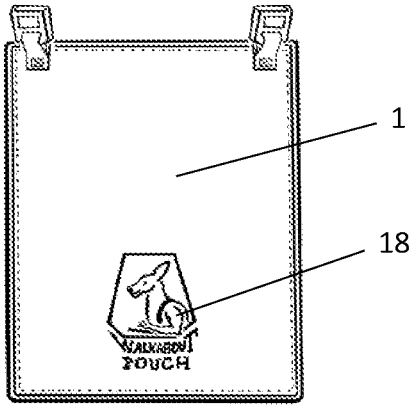
FIG. 12 is front view another exemplary support platform according to the present disclosure.

The support platform 1 may be substantially stiff such that it substantially retains its shape in the open position (and the closed position), as shown in FIGS. 1 and 7. As shown in FIGS. 1 and 7, the support platform 1 (or at least a portion or surface thereof) may be substantially planar. In one embodiment, the support platform 1 is formed of multiple layers of materials. For example, as shown in FIG. 9 two outer layers of fabric or other substantially soft or non-stiff material may form the outer and inner surfaces of the support platform 1. The user 19 may have physical contact with at least the inner surface of the platform 1 when the device is worn, as shown in FIGS. 6 and 7. The relatively soft outer layers of the support platform 1 may have other members or mechanisms attached thereto, such as being sown or otherwise attached to at least one of the outer layers. For example, at least one of the outer surfaces or layers of the support platform 1 may include at least one window, pocket, strap, buckle or other coupling mechanism, connector, ornamental decoration (e.g., a logo, name, symbol, or other ornamentation), harness portions, any other mechanism or member, or combinations thereof, as shown in FIGS. 6, 7, 9 and 12. In some embodiments, the interior and/or exterior surface of the support platform 1 may include at least one window pocket 1(*a*) that provides a cavity to store an item there-within, an opening for providing access to the cavity, and a transparent or translucent portion for providing line of sight into the cavity, as shown in FIG. 10. In some embodiments, the interior and/or exterior surface of the support platform 1 may include ornamental decoration (e.g., a logo, name, symbol, and/or any other ornamentation) 18, as shown in FIG. 12. For example, the interior and/or exterior surface of the support platform 1 may include a logo or other ornamentation 18 coupled thereto, such as via sewing, embroidering, printing, or any other method. Similarly, at least one interior and/or exterior surface of the body harness may include a logo or other ornamentation 18 coupled thereto, which may be visible when the body harness is worn by a user.

In some embodiments, the support platform 1 may be formed of or include at least one substantially soft and/or non-rigid layer or material (that may form the interior and/or exterior surface of the platform 1) and at least one substantially rigid layer or material. For example, the platform 1 may include an assembly of a substantially rigid panel or frame portion 15 with at least one substantially soft and/or non-rigid layer or material coupled thereto, such as being adhered to one of the rigid portion's 15 sides, as shown in FIG. 9. In one exemplary embodiment, the platform 1 is formed of an assembly of at least one substantially rigid layer or material 15, such as a substantially rigid inner panel of acrylic or other stiff material, and substantially soft and/or non-rigid layers or materials adhered or coupled at or to interior and exterior surfaces of the rigid layer or material 15 (which may form the interior and exterior surfaces of the platform 1), as shown in FIG. 9. In some embodiments, the at least one substantially soft and/or non-rigid layer or material may be relatively thin (e.g., approximately 1/16 inch thick) and substantially cover the rigid layer or material 15. The at least one substantially soft and/or non-rigid layer or material may be padding or lining applied to the rigid layer or material 15. In some embodiments, after any components, mechanisms and/or adornments are coupled to the at least one substantially soft and/or non-rigid layer or material, it may be coupled to the rigid layer or material 15. In some embodiments, the material forming the support platform 1 (e.g., substantially rigid and/or non-rigid material) may be configured to form edges or seams used in final/finishing construction of the support platform 1. However, the support platform 1 may be formed or constructed in any way of any materials. For example, the support platform 1 may or may not include at least one substantially soft and/or non-rigid layer or material, and may or may not include at least one rigid layer or material. As another example, layers or materials other than, or in addition to, the at least one substantially soft and/or non-rigid layer or material and/or the at least one rigid layer or material 15, may be utilized to form the support platform 1.

In one exemplary non-limiting embodiment, the platform 1 may include a substantially rigid frame portion 15 that is formed of a reinforcing material sewn or otherwise attached to at least the body-facing interior side or surface of the platform 1. The frame portion 15 may extend at least partially about the item attachment portion 16, such as extending at least on opposing sides of the item attachment portion 16. The rigid frame portion 15 may reinforce the user-facing interior side of the platform 1. The rigid frame portion 15 may also at least partially frame the item attachment section 16, to reinforce the strength of the item attachment portion 16.

The interior surface of the support platform 1 that substantially faces the user 19 (when the device is worn by the user 19) may include an item support portion 16, as shown in FIG. 8. In some embodiments, the item support portion 16 may be a planar or non-planar surface. In some embodiments, the item support portion 16 may be a surface or feature configured to removable couple or support an item to the support platform 1. In some embodiments, the item support portion 16 may form or include a pocket, shelf or other supportive surface (e.g., a non-slip surface). For example, the item support portion 16 may form or include an item-specific or general casing (e.g., a pre-molded flexible casing), that may be sewn or otherwise attached to the interior side or surface of the support platform 1 that is configured to hold or couple at least one item. In some embodiments, the item support portion 16 may be or include at least one coupling or fastening mechanism configured to removably couple with item to removably couple the item to the support platform 1 of the device. For example, the item support portion 16 may be or include at least one coupling mechanism, and the item may include a mating coupling mechanism, configured to removably couple the item to the support platform 1. In one exemplary embodiment, the item support portion 16 may be or include at least one portion of a hook and loop fastener, and a mating at least one portion of the hook and loop fastener portion may be provided or coupled to the item to removably couple the support platform 1 and the item. However, as noted above, the item support portion 16 of the support platform 1 may be any configuration effective to removably couple an item, such as an electronic item and/or non-electronic item, to the interior surface of the support platform 1.

As discussed above, the item support portion 16 of the support platform 1 may be any configuration effective to removably couple an item to the interior surface of the support platform 1 such that the item is accessible when the platform 1 is in the open configuration and stowed between the user and the platform 1. For example, the item support portion 16 of the support platform 1 may be configured to hold and display the user's item on its body-facing interior side when in the open position, and position and secure the item against or proximate to the user's torso when in the closed position, as shown in FIGS. 6 and 7. In the open position, the platform 1 may be angled away from the user 19 from the bottom end thereof to the top end thereof such that the top end of the platform 1 defines a free end that is distal to the user 19, as shown in FIG. 7. In some embodiments, the platform 1 may be angled with respect to the front of the user's torso within the range of about 10 degrees to about 90 degrees, such as within the range of about 15 degrees to about 60 degrees. In some embodiments, the platform 1 may be angled with respect to the front of the user's torso within the range of about 30 degrees to about 55 degrees. In the illustrated exemplary embodiment shown in FIG. 7, the platform 1 may be angled with respect to the front of the user's torso at about 30 degrees. The support platform 1 may be configured to pivot between the open and closed positions from the bottom end or end portion thereof.

As shown in FIGS. 1, 6, 7 and 11, the support platform 1 and/or the harness may be configured such that the support platform is coupled proximate to the front of the user's torso in the closed position. The support platform 1 may pivot upwardly from the open position to the closed positon such that the top or free end of the support platform 1 is rotated toward the user, and the harness and the support platform 1 may be configured to removably couple in such an orientation to selectively maintain the closed arrangement or position. The support platform 1 may be configured to couple to the harness in the closed position, the harness may be configured to couple to the support platform 1 in the closed position, or the support platform 1 and the harness may be configured to couple to each other in the closed position. For example, as shown in FIGS. 1, 6, 7 and 11, a top portion of the support platform 1 proximate to the top end or edge thereof may be configured to removably couple with the front portion 4 of the body harness, such as to an outward facing side thereof, in the closed position to selectively maintain the support platform in the closed position. In some such embodiments, a front portion 4 of at least one shoulder strap of the harness and the top portion of the platform 1 may be configured to selectively removably couple.

Figure 11:
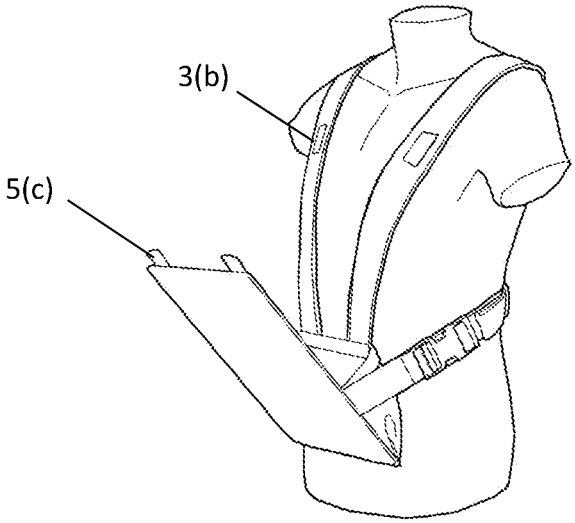
FIG. 11 is a perspective view another exemplary hands-free item carrying device according to the present disclosure worn by a user and in an open configuration.

In some embodiments, at least one of the support platform 1 and the front portion 4 of the body harness, such as shoulder straps thereof, includes a couple mechanism 3 configured to removably couple the top portion of the support platform 1 to the front portion 4 of the body harness in the closed position, as shown FIGS. 1, 6, 7 and 11. The selective or removable coupling between the platform 1 and the front portion 4 of the harness, such as to one or more shoulder straps thereof, may be accomplished via at least one coupling mechanism 3 of any type or configuration. For example, mating coupling mechanisms 3 may be provided on the platform 1, such as at the top end or top portion thereof, and the harness, such as on the outer surface of the front portion 4 of the harness (e.g., on a pair of shoulder straps), as shown in FIGS. 7 and 11. The mating coupling mechanisms 3 may be configured to mate and removably couple the platform 1 to the harness in the closed position, as shown in FIG. 6. For example, in one embodiment a buckle or snap type coupling mechanisms 3 may be utilized to selectively removably couple the platform 1 to the front portion 4 of the harness in the closed position, as shown in FIGS. 6 and 7. The coupling mechanisms 3 may be coupled to the front portion 4 of the shoulder straps of the harness via straps 2. The length of the straps 2 may be configured to position the platform 1 in the closed position when the coupling mechanisms 3 are mated or coupled together. In another exemplary embodiment, mating hook and loop fasteners 5(*c*), 3(*b*) may be provided on the top portion of the platform 1 and on the outer face of the front portion 4 of the shoulder straps of the harness, as shown in FIG. 11. The mating hook and loop fasteners 5(*c*), 3(*b*) may be configured to selectively removably couple the platform 1 to the front portion 4 of the shoulder straps in the closed position. However, as described above, any fastening mechanism(s) in any locations may be employed to selectively removably couple the platform 1 to the front portion 4 of the harness in the closed position.

In one non-limiting example as shown in FIG. 7, the coupling mechanisms 3 of the front portion 4 of the shoulder straps of the harness may be coupled via straps 2. The straps 2 may be coupled to the coupling mechanisms 3 and the front portion 4 of the shoulder straps, as shown in FIG. 7. The straps 2 may be configured to minimize slack and movement of the assembly. In some embodiments, the straps 2 may be within the range of 1 inch to several inches long, as shown in FIG. 7. The other mating coupling mechanisms 5 of the platform 1 may be coupled to the top end or top portion of the platform 1, as shown in FIG. 7. The mating coupling mechanisms 5 may be attached to the platform 1 directly or indirectly, such as via straps 6. If utilized, the straps 6 of the platform 1 may be at least substantially similarly configured to the straps 2 of the front portion 4 of the harness, as shown in FIG. 7. In some embodiments, the mating coupling mechanisms 5 may be symmetrically aligned across the top of the platform 1, allowing them to easily meet and be connected with the coupling mechanism 3 of the front portion 4 of the shoulder straps when the platform 1 is in the closed position, as shown in FIG. 7. The coupling mechanisms 5 of the platform 1 may be positioned to align and mate with the coupling mechanisms 2 of the front portion 4 of the shoulder straps, as shown in FIG. 7. In some embodiments, the coupling mechanisms 5 of the platform 1 and the coupling mechanisms 2 of the front portion 4 of the shoulder straps may be configured so that they are aligned and able to relatively easily mate when the platform 1 is in the closed position, as shown in FIG. 6.

In some embodiments, the platform 1 and the front portion 4 of the harness may be selectively removably coupled to selectively maintain the platform 1 in the closed position via one or more coupling mechanism 3 that is accessible by the user 19 via the front portion of the device, such as accessible by the user 19 via the front portion of the shoulder straps and/or the top portion (and/or the exterior side) of the platform 1. The coupling mechanism 3 may thereby be of a "front-release" and "front-connect" design allowing for connection and disconnection by one or more hand of the user 19 (when the harness is worn by the user 19).

In some embodiments, the platform 1 and the front portion 4 of the harness may be selectively removably coupled in the closed position such that a gap or space is formed between the interior side or surface of the platform 1 and the front of the user's torso, as shown in FIG. 6. In some embodiments, the gap between the platform 1 and the front of the user's torso in the closed position of the platform 1 may with the range of one to several inches. The gap between the platform 1 and the front of the user's torso in the closed position of the platform 1 may allow for any items coupled or supported by the platform 1 (e.g., via the portion or mechanism 16) (and/or the stabilizing portion 14, as discussed further below) to be accommodated while not in use.

As noted above, the hands-free item carrying device may include a flexible stabilizing portion 14 coupled to a bottom portion of the support platform 1 at or proximate to the bottom end thereof and positioned adjacent the interior surface thereof, as shown in FIGS. 1, 6, 7 and 8. The front portion 4 of the body harness, such as the front portion 4 of the shoulder straps, may be coupled to the stabilizing portion 14, as shown in FIGS. 1, 6, 7 and 8. A back portion 7 of the body harness, such as the back portion 7 of the shoulder straps, may also be coupled to the stabilizing portion 14, as shown in FIGS. 1, 6, 7 and 8. When the harness is worn by the user 19, the stabilizing portion 14 may thereby be positioned between the user 19 and the support platform 1, as shown in FIGS. 6 and 7.

The stabilizing portion 14 may extend away from the interior surface of the support platform 1, as shown in FIGS. 1, 6, 7 and 8. For example, the bottom end portion of the support platform 1 may define a first width, and the stabilizing portion 14 may define a second width that is larger than the first width. However, the lateral sides of the platform 1 and the stabilizing portion 14 may be aligned (or the stabilizing portion 14 may be positioned interior of the lateral edges of the platform 1) so that the stabilizing portion 14 may extend away from the interior surface of the support platform 1. In some embodiments, the stabilizing portion 14 may define a length or thickness (rather than width, for example) such that is extends away from the interior surface of the support platform 1. The stabilizing portion 14 may be coupled to and extend along a portion of the interior surface of the platform portion 1 along a length direction that extends between the bottom and top ends thereof, as shown in FIGS. 1, 6, 7 and 8. In such an embodiment, the stabilizing portion 14 may be coupled to and extend along a portion of the interior surface of the platform portion 1 along a width direction that extends between opposing lateral sides of the support platform 1 that extend between the bottom and top ends thereof.

In some embodiments, the stabilizing portion 14 may be attached to the platform 1 in such a way to as to create a pouch on the body-facing interior side of the platform 1. The shape and method of attaching the stabilizing portion 14 to the platform 1 may form or create the pouch. For example, the stabilizing portion 14 may form a pouch or pocket via a front portion that is coupled to the interior surface of the platform portion 1, a back portion that is spaced from the interior surface of the platform portion 1, and opposing side portions 13 that extend between the front and back portions, as shown in FIGS. 1, 6, 7 and 8. A cavity of the pouch formed by the stabilizing portion 14 may extend along a length direction that extends between the bottom and top ends of the support platform 1, and along a width direction that extends between opposing lateral sides of the support platform 1 that extend between the bottom and top ends along the length direction. The pouch formed by the stabilizing portion 14 may thus be a compartment located between the platform 1 the user 19. The pouch arrangement of the stabilizing portion 14 may be formed of material that is pleated or folded inwardly into the interior of the pouch to form the opposing side portions 13. For example, the stabilizing portion 14 may be articulated into three sections and then folded so that the inner edges of the two outer sections are tucked underneath the middle section into an 'accordion' type of folded formation, and then sewn or otherwise coupled to the lower portion of the platform 1 in such an arrangement. The opposing side portions 13 may allow the back portion of the stabilizing portion 14 to be spaced from the interior surface of the platform portion 1, as shown in FIGS. 1, 6, 7 and 8. The pouch arrangement of the stabilizing portion 14 may allow at least one item to be carried or retained within the pouch, when the platform 1 is in the open and/or closed positions. In this way, the pouch arrangement of the stabilizing portion 14 may provide hands-free accessible storage of additional items. However, the stabilizing portion 14 may not form a pouch, and may be any configuration or arrangement of material or member(s) that is coupled to the bottom or lower portion of the platform 1 and secures the platform 1 to the body harness, and to the user 19 when the device is worn by the user 19. In some embodiments, the stabilizing portion 14 may be formed of one or more layers of fabric or similar material. In some embodiments, the stabilizing portion 14 may be positioned below the midpoint of the height or length of the platform 1. For example, the stabilizing portion 14 may be positioned about ⅓ the height or length of the platform 1.

Although the stabilizing portion 14 may be flexible, it may securely position the bottom end or end portion of the platform 1 to the user's stomach or lower torso. Further, the flexibility of the stabilizing portion 14 may allow the platform 1 to pivot between the open and closed arrangements. For example, the stabilizing portion 14 may prevent the platform 1 from over-rotating and flipping over or inside-out. As another example, the stabilizing portion 14 may prevent excessive movement of the lower portion of the platform 1 laterally along the width direction. In some embodiments, the stabilizing portion 14 may be located on or over the entirety, or at least a substantially portion, of the bottom third of the body-facing interior side of the platform 1. The edges of the stabilizing portion may or may not align with the edges of the bottom portion of the platform 1, and may be sew or otherwise coupled thereto.

The stabilizing portion 14 may also be utilized to secure the platform 1 to the harness, such as to front portions 4 and back portions 7 of the shoulder straps of the body harness, as shown in FIGS. 1, 6, 7 and 8. As shown in FIGS. 1, 6, 7 and 8, at least one front end portion 4 of the body harness, such as the shoulder straps, may be coupled to a medial portion of the stabilizing portion 14 along the width direction. For example, the front end portion 4 of the body harness, such as the shoulder straps, may be coupled to a top edge or end of the back portion of the stabilizing portion 14 that is spaced (or able to be spaced) from the interior surface of the platform 1 (at least in the open position). As also shown in FIGS. 1, 6, 7 and 8, at least one back end portion 7 of the body harness, such as the shoulder straps, may be coupled to the stabilizing portion 14 and/or the platform 1. The back portion 7 of the body harness, such as the shoulder straps, may be coupled to the stabilizing portion 14 further outward along the width direction than the front end portion 4 of the body harness, as shown in FIGS. 1, 6, 7 and 8. For example, the portion 7 of the body harness, such as the shoulder straps, may be coupled to (or extend over) the side portions 13 of the stabilizing portion 14. Further, the back portion 7 of the body harness, such as the shoulder straps, may be coupled to the stabilizing portion 14 at or lower than the front end portion 4 of the body harness along the height or length direction, as shown in FIGS. 1, 6, 7 and 8. In one embodiment, the back portion 7 of the body harness, such as the shoulder straps, may be coupled to the stabilizing portion 14 (e.g., to the side portions 13 of the stabilizing portion 14) at about ⅓ the height or length of the platform 1 measured from the bottom end.

As shown in FIGS. 1, 6, 7 and 8, the front portion 4 of the shoulder straps may pass from over the shoulders of the user 19 and along the front torso of the user 19 and to the stabilizing portion 14. Similarly, the back end portions 7 of the shoulder straps may extend from over the shoulders of the user 19 and over the sides of the torso of the user 19 to the stabilizing portion 14 and/or platform 1, as shown in FIGS. 1, 6, 7 and 8. In this way, the back end portions 7 of the shoulder straps may extend over the hips or along the waist of the user 19 to the stabilizing portion 14 and/or platform 1.

In one non-limiting embodiment shown in FIGS. 1, 6, 7 and 8, the back end portions 7 of the shoulder straps may extend over the hips or along the waist of the user 19 to the stabilizing portion 14 and/or platform 1 via side straps 12 coupled to the stabilizing portion 14 and/or platform 1. The side straps 12 may be of a fixed length of strap, not adjustable, and connect the back portion 7 of the shoulder harness straps to the stabilizing portion 14 and/or platform 1. The side straps 12 may include a selective and removable coupling mechanism 10 that is configured to selectively removably couple the side straps 12 to the back portion 7 of the straps. The coupling mechanism may be any mechanism that may allow a user 19 to disconnect the side straps 12 (or platform 1 and/or stabilizing portion 14) to the back portion 7 of the shoulder straps to allow the user 19 to place the shoulder straps over his/her shoulders, and then securely removable re-couple or connect the side straps 12 (or platform 1 and/or stabilizing portion 14) to the back portion 7 of the shoulder straps.

Although the side straps 12 may not be length-adjustable, the back portion 7 of the shoulder harness straps may be length adjustable to adjust to each user's size and/or fit preference. For example, the back portion 7 of the shoulder harness straps may include a length-adjustment mechanism 11 prior to the coupling mechanism 10. The length-adjustment mechanisms 11 may be any mechanisms that allow the length of the back portion 7 of the shoulder harness straps to be adjusted by the user, but remain a fixed length thereafter until being potentially re-adjusted. Any length 9 taken out of the back portion 7 of the shoulder harness straps via the length-adjustment mechanisms 11, and or available length 9 of the back portion 7 of the shoulder harness straps not being utilized, may be secured to the back portion 7 of the shoulder harness straps via an elastic loop 8 or other coupling mechanism. The elastic loop 8 or other coupling mechanism may secure the excess length 9 of the adjustable back strap 7 to the back strap 7. In this way, the coupling mechanisms 10 can be moved to any length or location of the back portion 7 of the shoulder harness straps via length-adjustment mechanisms 11 by the user 19, and any excess length 9 can be secured and stowed out of the way. However, any other connection mechanisms may be utilized to selectively removably attach the back portion 7 of the shoulder harness straps to the stabilizing portion 14 and/or platform 1, and any other length-adjustment mechanisms for adjusting the lengths of the portion 7 of the shoulder harness straps.

Figure 2:
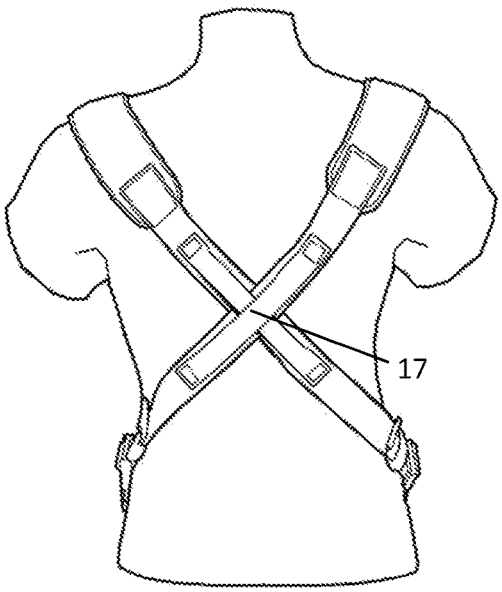
FIG. 2 is a back view of the hands-free item carrying device of FIG. 1 worn by a user illustrating an exemplary body harness thereof.
Figure 3:
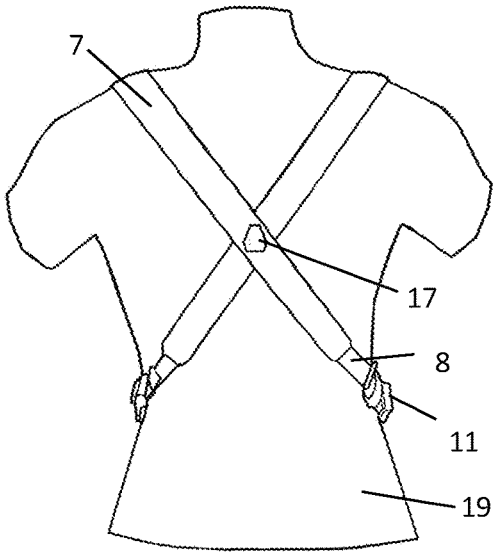
FIG. 3 is a back view of another exemplary body harness of a hands-free item carrying device according to the present disclosure worn by a user.
Figure 4:
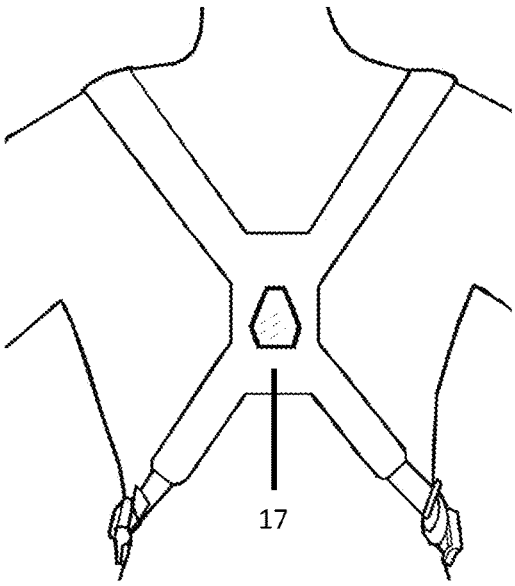
FIG. 4 is a back view of another exemplary body harness of a hands-free item carrying device according to the present disclosure worn by a user.
Figure 5:
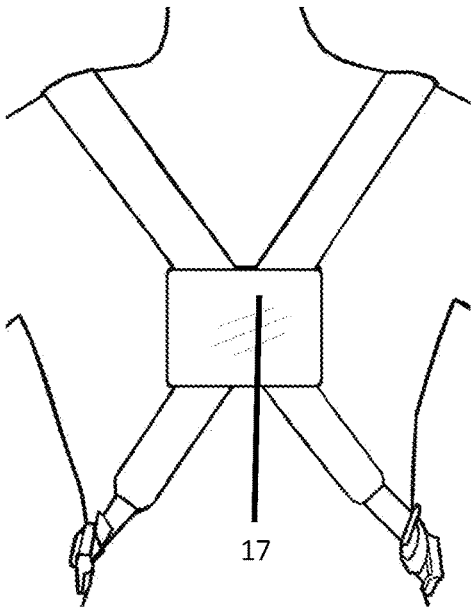
FIG. 5 is a back view of another exemplary body harness of a hands-free item carrying device according to the present disclosure worn by a user.

As shown in FIGS. 1-5, the back portion 7 of the shoulder harness straps may be coupled 17, and/or cross or overlap, along the user's 19 back, such as at the middle of the user's 19 back. As shown in FIGS. 3 and 5, the back portion 7 of the shoulder harness straps may be coupled in a crossover or crossed arrangement via a coupling mechanism 17 that couples the straps 7 so that one shoulder strap is securely crossed over the other shoulder strap, centered adjacent to the middle of the user's 19 back, and extend over the shoulder and around the waist of a user 19. For example, the coupling mechanism 17 can directly couple the straps 7 as shown in FIG. 3, or extend about the straps 7 to couple them together as shown in FIG. 5. In other embodiments, as shown in FIG. 4, the harness may include a back portion 17 that couples the straps 7 together so that they can extend over the shoulder and around the waist of a user 19. In some embodiments, the harness may include a left shoulder strap that includes a left front portion 4 (extending over the left side of the chest of the user 19) and a right back portion 7 (extending over the right side of the waist of the user 19), and a right shoulder strap that includes a right front portion 4 (extending over the right side of the chest of the user 19) and a left back portion 7 (extending over the left side of the waist of the user 19).

As shown in FIG. 2, in one embodiment a pair of strap overlays 17 may overlie a portion of the back straps 7. The strap overlays 17 may be short of (i.e., do not extend to) the stabilizing portion 14 and/or the platform 1. The strap overlays 17 may cross each other (i.e., one strap overlay 17 overlies and crosses over the other strap overlay 17) so that the back straps 7 cross each other. In some embodiments, the crossing portions of the back overlays 17 may be coupled together. At least one portion of at least one of the strap overlays 17 may not be coupled to the respective back strap 7 so that the other strap overlay 17 and/or associated back strap 7 can cross thereover between the non-coupled portion of the strap overlay 17 and the back strap 7. In some embodiments, a first portion of a first strap overlay 17 may not be coupled to an associated first back strap 7 (but be coupled in other portions), and a second portion of a second strap overlay 17 may not be coupled to an associated second back strap 17 (but be coupled in other portions). In this way, the back overlays 17 and back straps 7 may cross each other such that second back overlay 17 crosses over and between the first strap overlay 17 and the first back strap 7 (and thereby captured therebetween), with the second back strap 7 being positioned behind the first back strap 7. In this way, the first back strap 7 may cross over and between the second strap overlay 17 and the second back strap 7 (and thereby captured therebetween).

In some embodiments, the strap overlays 17 may be formed of lengths of strapping material, slightly narrower than the back straps 7. The strap overlays 17 may be sewn or otherwise attached to an outwardly-facing side or surface of the back straps 7. To serve their purposes, the strap overlays 17 may be located on the back straps 7 so that they are centered and are crossed over the approximate area of the middle of the user's 19 back and shoulder blades. For example, the strap overlays 17 top ends may be slightly short of padded shoulder harness strap portions that pass over the user's 19 shoulders, and their bottom ends may be substantially short of the connection mechanisms 10 to the side straps 12 and or the platform 1 and/or stabilizing portion 14. The shoulder strap overlays 17 may provide for weight distribution and support. The shoulder strap overlays 17 may guide the shoulder straps of the harness to lie evenly across a user's 19 back, evenly distributing and supporting the weight of the device and any item(s) carried and supported by the device. The shoulder strap overlays 17 may also prevent the shoulder straps from falling off a user's 19 shoulders during use of the device.

The shoulder straps of the harness, such as the back portions 7, front portions 4, and/or padded shoulder harness strap portions may be formed of a padded fabric or similar material. The padded nature of the shoulder straps of the harness may support the weight of the device any item(s) carried and supported thereby, securely fasten the platform 1 into closed position against a user's 19 torso, and/or not be restrictive or constraining, or fall off from, the user's 19 torso, shoulder or arms while wearing the harness.

In one non-limiting example, the shoulder straps of the harness, such as the back portions 7, front portions 4, and/or padded shoulder harness strap portions, may be formed of two layers of outer fabric with a middle layer of padding fabric between them, all layers sewn or otherwise coupled together. After said shoulder straps are formed, they may be attached to the stabilizing portion 14 and/or platform 1. For example, the shoulder straps may be coupled to the stabilizing portion 14, centered across its width and spaced below its top finished edge, and/or spaced apart from each other. The straps may also be coupled to the coupling mechanism 10, the side straps 10 and/or the stabilizing portion 14 and/or platform 1.

It is to be understood that the above description is intended to be illustrative, and not restrictive. Numerous changes and modifications may be made herein by one of ordinary skill in the art without departing from the general spirit and scope of the inventions as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably connected" is used herein to refer to both connections resulting from separate, distinct components being directly or indirectly coupled and components being integrally formed (i.e., monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the inventions have been described in detail in connection with only a limited number of embodiments, it should be readily understood that the inventions are not limited to such disclosed embodiments. Rather, the inventions can be modified to incorporate any number of variations, alterations, substitutions or equivalent arrangements not heretofore described, but which are commensurate with the spirit and scope of the inventions. Additionally, while various embodiments of the inventions have been described, it is to be understood that aspects of the disclosure may include only some of the described embodiments. Accordingly, the inventions are not to be seen as limited by the foregoing description, but are only limited by the scope of the appended claims.

This written description uses examples to disclose the inventions, including the best mode, and also to enable any person skilled in the art to practice the inventions, including making and using any devices or systems and performing any incorporated methods. The patentable scope of the inventions are defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A hands-free item carrying device, comprising:

a support platform including an interior surface with an item support portion, a bottom end and a top end;

a flexible stabilizing portion coupled to the bottom portion of the support platform and extending away from adjacent to the interior surface; and a body harness comprising a pair of shoulder straps, at least one first end portion coupled to the stabilizing portion, and at least one second end portion coupled to at least one of the stabilizing portion and the support platform, wherein, when the shoulder straps are worn by the user, the stabilizing portion is positioned between the user and the support platform, and the support platform is selectively movable between an open positioned with the support platform angling away from the user from the bottom end to the top end such that the top end defines a free end that is distal to the user, and a closed positioned with the top end of the support platform proximate to the user, wherein the support platform is configured to pivot between the open and closed positions.

2. The item carrying device of claim 1, wherein a top portion of the support platform is removably coupled to the front portion of the body harness in the closed position to selectively maintain the support platform in the closed position, and wherein at least one of the support platform and the front portion of the body harness includes a couple mechanism configured to removably couple the top portion of the support platform to the front portion of the body harness in the closed position.

3. The item carrying device of claim 1, wherein the item support portion of the support platform is configured to removably couple an item to the support platform.

4. The item carrying device of claim 1, wherein the support platform is substantially stiff such that it maintains its shape in the open and closed positions, and wherein the support platform includes a rigid member that extends across a width and a length of the support platform.

5. The item carrying device of claim 4, wherein the rigid member comprises a rigid panel or frame.

6. The item carrying device of claim 1, wherein the at least one second end portion of the body harness is coupled to the stabilizing portion and the support platform.

7. The item carrying device of claim 1, wherein the end portion of the support platform defines a first width, and wherein the stabilizing portion defines a second width that is larger than the first width.

8. The item device carrier of claim 1, wherein the stabilizing portion is coupled to and extends along a portion of the interior surface of the support platform along a length direction that extends between the bottom and top ends.

9. The item device carrier of claim 1, wherein the stabilizing portion is coupled to and extends along a portion of the interior surface of the support platform along a width direction that extends between opposing lateral sides of the support platform that extend between the bottom and top ends, and wherein the at least one first end portion of the body harness is coupled to a medial portion of the stabilizing portion along the width direction.

10. The item carrying device of claim 1, wherein the stabilizing portion forms a pouch via a front portion that is coupled to the interior surface of the support platform, a back portion that is spaced from the interior surface of the support platform, a base portion that forms the bottom of the pouch and extends between the front and back portions, and opposing side portions that extend between the front and back portions and upwardly from the base portion.

11. The item carrying device of claim 10, wherein the stabilizing portion forms a cavity of the pouch that extends along a length direction that extends between the bottom and top ends of the support platform, and along a width direction that extends between opposing lateral sides of the support platform that extend between the bottom and top ends along the length direction.

12. The item carrying device of claim 10, wherein the at least one first end portion of the body harness is coupled to the back portion of the stabilizing portion.

13. The item carrying device of claim 1, wherein a length of the at least one second end portion of the body harness is adjustable to adjust the position of the support platform in the open position.

14. The item carrying device of claim 1, wherein the body harness includes a pair of first end portions that comprise ends portions of front portions of the pair of shoulder straps, and wherein the body harness includes a pair of second end portions that are configured to removably couple to side portions of the body harness that are coupled to back portions of the pair of shoulder straps.

15. The item carrying device of claim 1, wherein back portions of the pair of shoulder straps are coupled together.

16. The item carrying device of claim 1, further comprising a pair of strap overlay members coupled to the outer surface of back portions of the pair of shoulder straps, wherein the strap overlay members couple the back portions of the pair of shoulder straps in a crossed arrangement.

17. The item carrying device of claim 16, wherein a first portion of a first strap overlay member that is coupled to a back portion of a first shoulder strap is not directly coupled to the first shoulder strap, and a second portion of a second strap overlay member that is coupled to a back portion of a second shoulder strap is not directly coupled to the second shoulder strap, and wherein the first portion of the first strap overlay member extends across the second shoulder strap between the second shoulder strap and the second portion of the second strap overlay member.

18. The item carrying device of claim 17, wherein the second strap extends across the first shoulder strap between the first shoulder strap and the first portion of the first strap overlay member, and wherein the first and second strap overlay members are configured such that, when the shoulder straps are worn by the user, the crossover of the first and second shoulder straps is substantially centered along the user's back.

19. The item carrying device of claim 1, wherein the interior surface of the support platform is substantially planar.

20. The item carrying device of claim 1, further comprising an enclosed pouch with an open top that is formed at least partially by the stabilizing portion and is positioned adjacent to the to the interior surface of the bottom portion of the support platform.

21. The item carrying device of claim 20, wherein the enclosed pouch comprises a back portion that is spaced from the interior surface of the bottom portion of the support platform, a base portion that forms a bottom of the pouch and is coupled to the interior surface of the bottom portion of the support platform and extends from the back portion, and opposing lateral side portions that extend away from the interior surface of the bottom portion of the support platform to the back portion and upwardly from the base portion.

22. A method of manufacturing a hands-free item carrying device, comprising:

obtaining a support platform including an interior surface with an item support portion, a bottom end and a top end;

coupling a flexible stabilizing portion to a bottom portion of the support platform such that the flexible stabilizing portion is extends away from adjacent to the interior surface of the support platform; and coupling at least one first end portion of a body harness comprising a pair of shoulder straps to the stabilizing portion, and coupling at least one second end portion of the body harness to at least one of the stabilizing portion and the support platform such that when the shoulder straps are worn by the user, the stabilizing portion is positioned between the user and the support platform, and the support platform is selectively movable between an open positioned with the support platform angling away from the user from the bottom end to the top end such that the top end defines a free end being distal to the user, and a closed positioned with the top end of the support platform being positioned proximate to the user, wherein the stabilizing portion forms a pouch via a front portion that is coupled to the interior surface of the support platform, a back portion that is spaced from the interior surface of the support platform, and opposing side portions that extend between the front and back portions, and wherein the support platform is configured to pivot between the open and closed positions.

* * * * *